United States Patent [19]

Mullenax

[11] Patent Number: 4,805,934

[45] Date of Patent: Feb. 21, 1989

[54] SLIP-ON ATTACHMENT FOR SKATEBOARDS

[76] Inventor: Kem E. Mullenax, 823 S. Logan, Colorado Springs, Colo. 80910

[21] Appl. No.: 119,508

[22] Filed: Nov. 12, 1987

[51] Int. Cl.[4] ..... A63C 17/18

[52] U.S. Cl. ..... 280/7.12; 280/13; 280/87.042

[58] Field of Search ..... 301/5.3, 41 R; 280/7.12, 8, 10, 11.12, 12 A, 13, 809, 87.04 A, 7.14

[56] References Cited

U.S. PATENT DOCUMENTS

| | | | |
|---|---|---|---|
| 1,332,273 | 3/1920 | Schick | 301/41 R |
| 3,435,873 | 4/1969 | Weier | 301/41 R X |
| 3,618,963 | 11/1971 | Romano | 280/7.12 |
| 3,626,774 | 12/1971 | Schon | 74/230.3 |
| 4,043,565 | 8/1977 | Mogannam | 280/11.12 |
| 4,114,913 | 9/1978 | Newell et al. | 280/12 H |
| 4,116,455 | 9/1978 | Dotson et al. | 280/7.12 |
| 4,194,753 | 3/1980 | Schrishuhn, Jr. | 280/7.12 X |
| 4,360,210 | 11/1982 | Osting | 280/13 |

FOREIGN PATENT DOCUMENTS

| | | | |
|---|---|---|---|
| 357010 | 10/1961 | Switzerland | 301/5.3 |

*Primary Examiner*—David M. Mitchell
*Assistant Examiner*—Michael Mar
*Attorney, Agent, or Firm*—Henderson & Sturm

[57] ABSTRACT

A slip-on attachment apparatus (10) for the conventional wheels (100) of a typical skateboard device (101) wherein the attachment apparatus (10) comprises a plurality of attachment members (11) including a generally elongated hollow cylindrical housing (13) having at least one outwardly and radially disposed narrow runner element (12) formed thereon; wherein, the interior of the cylindrical housing (13) is adapted to engage the outer periphery of the wheels (100) of a skateboard (101).

3 Claims, 1 Drawing Sheet

SLIP-ON ATTACHMENT FOR SKATEBOARDS

TECHNICAL FIELD

The present invention relates in general to convertible arrangements for skateboards; and, in particular to a slip-on adapter to convert the wheel configuration on a skateboard.

BACKGROUND OF THE INVENTION

As can be seen by reference to the following U.S. Pat. Nos. 4,043,565; 4,114,913; 3,626,774; and, 4,116,455 the prior art is replete with myriad and diverse substitute wheel constructions that are intended to convert the typical rolling wheel transport of the skateboard into a sliding runner mode of transport.

Unfortunately as is the case with the aforementioned prior art devices, the uniform method of affecting the conversion of the skateboard from wheels to runners requires the physical substitution of a runner element after the wheel element has been physically removed from the skateboard axle.

While this substitution process admittedly produces a converted skateboard apparatus that is more than adequate for the purpose and function for which the skateboard was converted; this process involves multiple steps, significant physical exertion, the expenditure of a great deal of time; and, the use of specialized tools to remove the wheel and install the runner.

In view of the foregoing situation there has obviously existed a long standing need among users of skateboards for a quickly and simply installed conversion arrangement that could be attached and detached from the skateboard in a matter of seconds without the use of tools; and, which would also not require that the standard equipment wheels be removed from the skateboard axles.

BRIEF SUMMARY OF THE INVENTION

The present invention involves in general a slip-on attachment unit that will engage the periphery of the conventional wheels of a skateboard to convert the configuration of the surface contacting portion of the conventional wheels into a quasi-runner configuration; whereby, the converted skateboard construction will be adapted for use on relatively slick surfaces such as ice and snow.

The slip-on attachment unit comprises in general a generally hollow cylindrical attachment member which is adapted to fit over and frictionally engage the ground contacting periphery of the conventional skateboard wheels; wherein, the attachment member is provided with at least one radially disposed relatively narrow runner element that projects outwardly from the periphery of the attachment member.

In addition, by virtue of the frictional engagement between the attachment member and the conventional skateboard wheel, the wheel will not be restrained from rotation about its related axle; however, the attachment member will now only make narrow rotary point contact with the surface being traversed by the skateboard, by virtue of the presence of the at least one runner element on the attachment member.

Furthermore, the design and construction of the slip-on attachment unit will allow a skateboard to be converted in a matter of seconds without the use of any tools nor any particular degree of manual dexterity. Conversely, the skateboard may be returned to its normal wheeled configuration in a like manner and without a great deal of physical exertion.

BRIEF DESCRIPTION OF THE DRAWINGS

These and other objects, advantages, and novel features of the invention will become apparent from the detailed description of the best mode for carrying out the preferred embodiment of the invention which follows; particularly when considered in conjunction with the accompanying drawings, wherein.

BEST MODE FOR CARRYING OUT THE INVENTION

Figure 1:
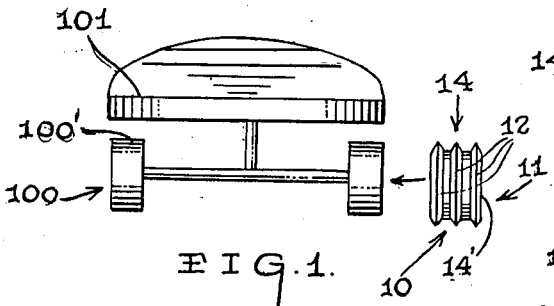
FIG. 1 is an exploded perspective view depicting the cooperation of the slip-on attachment apparatus of the invention with the conventional wheels of a skateboard.

As can be seen by reference to the drawings and in particular to FIG. 1, the slip-on skate attachment apparatus that forms the basis of the present invention is designated generally by the reference numeral (10) and is intended for use in conjunction with the conventional wheels (100) of a typical skateboard device (101). The attachment apparatus (10) comprises in general a plurality of attachment members (11); wherein each attachment member is provided with at least one narrow outwardly and radially disposed runner element (12).

Figure 2:
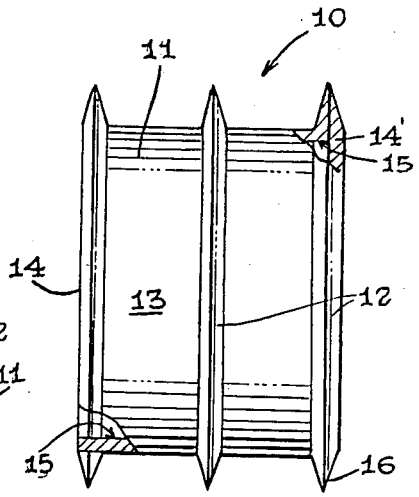
FIG. 2 is an isolated view of the attachment apparatus.

As can best be appreciated by reference to FIGS. 1 and 2, each of the attachment members (11) comprise a generally elongated hollow cylindrical housing (13) having an open inboard end (14) and a closed outboard end (14'); wherein, the interior walls (15) of the hollow cylindrical housing (13) are dimensioned and designed to receive and frictionally engage the periphery (100') of one of the conventional wheels (100) of a skateboard. Furthermore, the closed outboard end (14') of the housing will serve to limit the amount of lateral travel that may be permitted between the wheel (100) and the cylindrical housing (13).

As can also be seen by reference to FIGS. 1 and 2, the cylindrical housing (13) of the preferred embodiment is actually provided with a plurality of relatively narrow runner elements (12) that are spaced from one another and radially disposed on the periphery of the cylindrical housing (13); wherein the outboard ends of the radial runner elements (12) terminate in pointed runner blade members (16).

As shown in FIGS. 2 thru 8, some of the runner blade members (16) contemplated for use in this invention have a single blade configuration (16') (i.e. FIGS. 2, 5, and 8) while other runner blade members (16) have a double blade configuration (16'') (i.e. FIGS. 3, 4, 6 and 7). In the single blade embodiment (16') illustrated in FIG. 2, the runner blade members (16) are provided with a generally sharp knife blade edge cross-section. In the single blade embodiments (16') illustrated in FIG. 5, the runner blade members (16) are provided with a generally blunt knife blade edge cross-section; and, in FIG. 8 the runner blade members (16) are provided with a stepped shoulder pin joint edge cross-sectional configuration.

Figure 3:
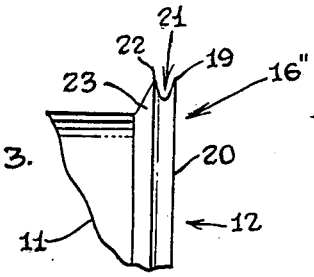
FIGS. 3 thru 8 are enlarged detail views of various runner element configurations contemplated for use on the attachment apparatus.

With respect to the double blade embodiments, as shown in FIG. 3, the outboard blade (19) terminates in a vertical face (20); wherein an arcuate recess (21) is formed between the inboard (22) and outboard (19) blades; and, wherein the inboard edge of the inboard blade (22) terminates in a tapered wall (23).

Figure 4:
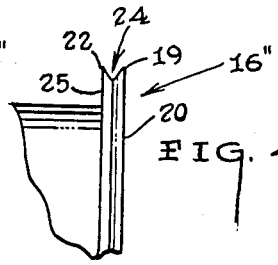
Figure 5:
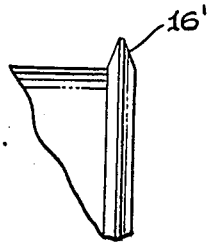

In the version depicted in FIG. 4, the outboard blade (19) also terminates in a vertical face (20); wherein a V-shaped notch (24) is formed between the inboard (22) and outboard (19) blades; and, wherein the inboard blade (22) terminates in a vertical face (25).

Figure 6:
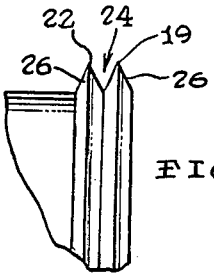
Figure 7:
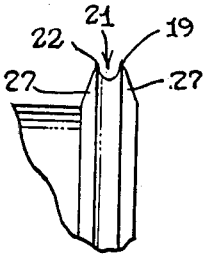
Figure 8:
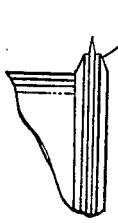

In the version depicted in FIG. 6, both the inboard (22) and outboard blades are provided with tapered faces (26); wherein, the intermediate tapered faces form a V-shaped notch (24); and, in the version depicted in FIG. 7 both the inboard (22) and outboard (19) terminal edges form tapered faces (27); and, an arcuate recess (21) is formed intermediate the outboard (19) and inboard (22) blades.

At this juncture it should be appreciated that the skate attachment apparatus (10) of this invention allows a conventional wheeled skateboard (101) to be instantaneously converted into a multi-bladed runner undercarriage simply by the provision of slipping the cylindrical attachment members (11) over the wheels (100) of the skateboard (101); thereby allowing the converted skateboard to be functionally deployed on slippery surfaces such as snow or ice. In addition, the plurality of runner elements (12) on each of the attachment members (11) enhances the frictional engagement and maneuvering control of the converted skateboard relative to the aforementioned slippery surfaces.

Having thereby described the subject matter of this invention, it should be obvious that many substitutions, modifications, and variations of the invention are possible in light of the above teachings. It is therefore to be understood that the invention as taught and described herein is only to be limited to the extent of the breadth and scope of the appended claims.

I claim:

1. A slip-on attachment apparatus for use in combination with the conventional wheels of a typical skateboard device wherein the apparatus consists of:

a plurality of attachment members, each attachment member being provided with at least one radially disposed runner means wherein each of the attachment members is adapted to slidingly engage the wheels of said typical skateboard device; and, each of the attachment members further comprises a generally elongated hollow cylindrical housing including an open inboard end; a closed outboard end; and, interior walls which are dimensioned to receive and frictionally engage the periphery of the wheels of said typical skateboard device; wherein said runner means comprises a plurality of radially projecting, axially spaced, narrow runner elements and each of said runner elements is comprised of at least one runner blade; and, wherein at least one of the runner elements is disposed adjacent the closed outboard end of said attachment member.

2. The apparatus as in claim 1 wherein said runner blades are provided with a single blade configuration.

3. The apparatus as in claim 2 wherein said runner blades are provided with a double blade configuration.

* * * * *